US006627026B2

(12) United States Patent
Andersson et al.

(10) Patent No.: US 6,627,026 B2
(45) Date of Patent: Sep. 30, 2003

(54) ADJUSTABLE CREASING TOOL

(75) Inventors: Ingvar Andersson, Löddeköpinge (SE); Thomas Pettersson, Stockamöllan (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 121 days.

(21) Appl. No.: 09/874,112

(22) Filed: Jun. 6, 2001

(65) Prior Publication Data

US 2001/0054487 A1 Dec. 27, 2001

(30) Foreign Application Priority Data

Jun. 26, 2000 (SE) ..... 0002374

(51) Int. Cl.[7] ..... D04H 00/00
(52) U.S. Cl. ..... 156/168; 100/176
(58) Field of Search ..... 100/155 R, 168 I, 100/172, 176; 72/249; 464/102, 103, 104, 106, 109, 147

(56) References Cited

U.S. PATENT DOCUMENTS 3,325,335 A 6/1967 Martensson
3,742,778 A * 7/1973 Sedlak ..... 74/395
4,233,997 A * 11/1980 Quester et al. ..... 131/315
5,035,037 A * 7/1991 Sprung ..... 493/471
5,058,496 A * 10/1991 Wittkopf ..... 100/35
5,274,983 A * 1/1994 Sjogren et al. ..... 53/399
5,582,569 A * 12/1996 Kowalewski et al. ..... 493/52
6,036,803 A 3/2000 Lasson et al.
6,209,291 B1 4/2001 Delén et al.
6,358,154 B1 * 3/2002 Murrell et al. ..... 464/81
6,464,589 B1 * 10/2002 Shinozuka ..... 464/102

* cited by examiner

*Primary Examiner*—Allen Ostrager
*Assistant Examiner*—Jimmy Nguyen
(74) *Attorney, Agent, or Firm*—Burns, Doane, Swecker & Mathis, L.L.P.

(57) ABSTRACT

The disclosure relates to an apparatus in an adjustable creasing tool (1). The creasing tool (1) includes two mutually co-operating creasing rollers, a male roller (2) and a female roller (3), a gear wheel transmission with a housing (8) for operation and mutual co-ordination of the creasing rollers (2, 3), means for adjusting the mutual position of rotation of the two creasing rollers (2, 3), means for adjusting the position of one of the creasing rollers along its axis of rotation, and means for adjusting the mutual spacing between the axes of rotation (4, 5) of the creasing rollers. Each respective shaft (4, 5) is fixedly connected to each respective gear wheel (6, 7) in the gear wheel transmission by means of rotationally rigid, both radially and axially limited, flexible couplings (9). These permit adjustment of the mutual positioning of the rollers (2, 3) without the meshing relationship of the transmission (8) needing to be affected. For adjustment of the mutual position of rotation of the rollers (2, 3), the transmission housing (8) may be restrictedly rotatably fixed in the frame of the creasing tool (1) about one of the shafts (4, 5) of the transmission.

5 Claims, 3 Drawing Sheets

ADJUSTABLE CREASING TOOL

This application claims priority under 35 U.S.C. §§119 and/or to Appln. No. 0002374-7 filed in Sweden on Jun. 26, 2000; the entire content of which is hereby incorporated by reference.

TECHNICAL FIELD

The present invention relates to an apparatus in an adjustable creasing tool which comprises two mutually co-operating creasing rollers, a male roller and a female roller, a gear wheel transmission with a housing for operation and mutual coordination of the creasing rollers, means for adjusting the mutual position of rotation of the two creasing rollers, means for adjusting the position of one of the creasing rollers along its axis of rotation, and means for adjusting the mutual spacing between the axes of rotation of the creasing rollers.

The creasing tool may be included in, for example, a machine for producing packaging material which is intended to be employed in a further machine in which the material is folded and joined together to form packages.

BACKGROUND ART

In existing creasing tools of the roller type, the rollers are mutually coordinated with a gear transmission with very slight flank play when in operation. On replacement of the material which is to be creased, it is necessary, in order to achieve acceptable creasing results, to adjust the mutual position between the male roller and the female roller of the creasing tool, if the material is of a different quality or has a deviating thickness. For gear transmissions intended for the above-mentioned use, a standard has as good as been developed. This implies that one of the gear wheels included in the transmission is split transversely in relation to its axis of rotation. In that the thus created parts are rotary in relation to one another, and may be mutually fixed by means of a releasable clamping element, a flank play which occurs in such instance in precision gear drives can be reduced so that the requisite accuracy may be maintained in the creasing tool.

The adjustment of creasing tools of the type under consideration here relates either to axial or mutually rotational adjustment or adjustment of the mutual spacing between the two rollers.

Axial adjustment is carried out by displacing one of the rollers and its shaft in relation to the gear transmission with the clamping element disengaged. In that the clamping element is disengaged for carrying out the axial adjustment, the adjustment of the split gear wheel will, however, also be affected so that this must be re-adjusted.

Tangential adjustment takes place with the clamping element disengaged in that the rotational position of the roller in relation to the gear wheel transmission is adjusted instead. The adjustment of the split gear wheel is also affected on this adjustment.

The adjustment of the mutual spacing between the two creasing rollers is carried out by insertion or removal of splines between the shafts of the two rollers which are pretensioned towards an engaged position. In that the split gear wheel in the gear transmission is adjustable for balancing the flank play of the transmission, the adjustment of the mutual spacing between the rollers should not involve any problems, since the adjustment is as slight as at most a few tenths of a millimetre and this may be compensated for by a new re-adjustment of the split gear wheel. However, such is nevertheless the case. It occasionally happens that adjustment of the spacing between the creasing rollers is carried out without therefore once again re-adjusting the flank play in the gear. The result will, in such instance, either be too slight a flank play, which may result in overheating the gear, or too large a flank play, which may result in a poor creasing result since the tangential adjustment fluctuates and will thereby be defective, and in that the transmission is quite simply worn out.

The problem in prior art adjustable creasing tools may therefore be summed up as follows. The adjustment of the flank play in creasing tool gears which, for achieving an acceptable creasing result, is realized by means of a transversely split gear wheel, gives rise to problems in connection with the other adjustment settings, in that this necessitates careful and accurate retro-adjustment of the split gear wheel. Since such additional retro-adjustment is both complicated and time consuming, it is perhaps not always put into effect in connection with adjustment of the spacing between the rollers, since this adjustment does not require that the releasable clamping element be disengaged. The result may be, in the event of too slight play, overheating in the gear, with consequential thermal transfer to the creasing roller of the split gear wheel, which may lead to thermal deformation, with a consequentially uneven creasing result. Too large a flank play immediately results in fluctuating, inexact creasing results and, in the long term, entails a risk of major failures, with operational downtime and heavy costs as a result.

Objects of the Invention

One object of the present invention is therefore to realize an apparatus in an adjustable creasing tool of the above-indicated type which makes for adjustment of both the position of one of the creasing rollers along its axis of rotation, as well as adjustment of the mutual spacing between the axes of rotation of the creasing tool, without the adjustment setting of the split gear wheel therefore needing to be affected.

Solution

These and other objects will be attained according to the present invention by means of an apparatus of the above-indicated type possessing the characterising features as set forth in the following.

BRIEF DESCRIPTION OF THE ACCOMPANYING DRAWINGS

The present invention will now be described in greater detail hereinbelow, with particular reference to the accompanying schematic Drawings. In the accompanying Drawings.

Figure 4A:
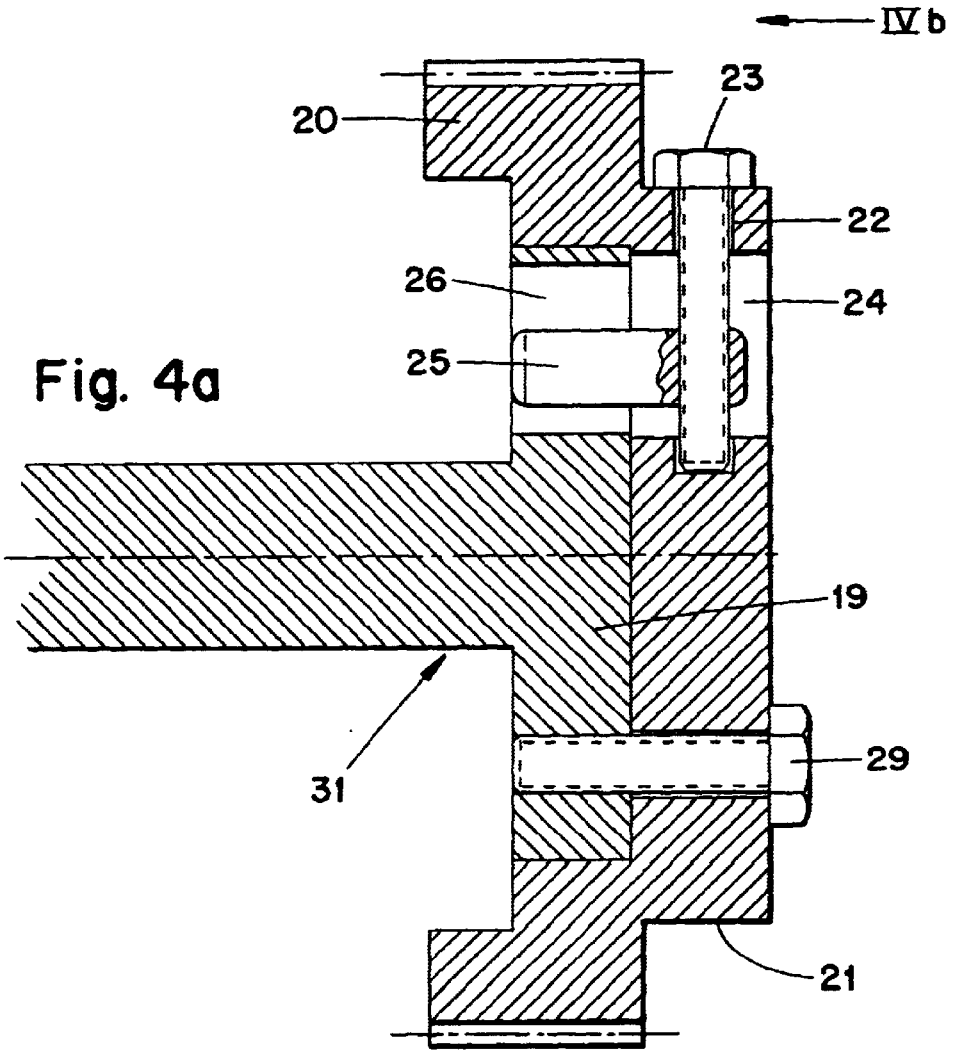
Figure 4B:
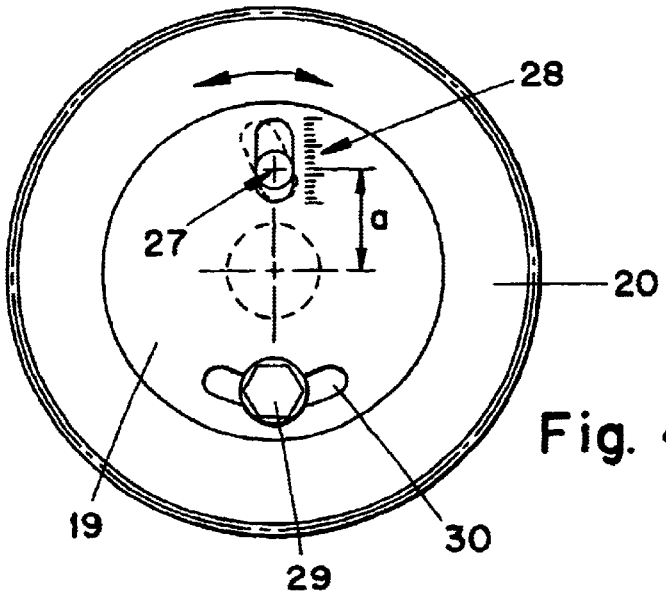

FIG. 4*a* is a cross section at one end of a shaft included in the creasing tool, from which is apparent an alternative embodiment of the adjustment apparatus, and FIG. 4*b* is a schematic view taken along the section Ivb—Ivb in FIG. 4*a*.

DESCRIPTION OF PREFERRED EMBODIMENT

Figure 1:
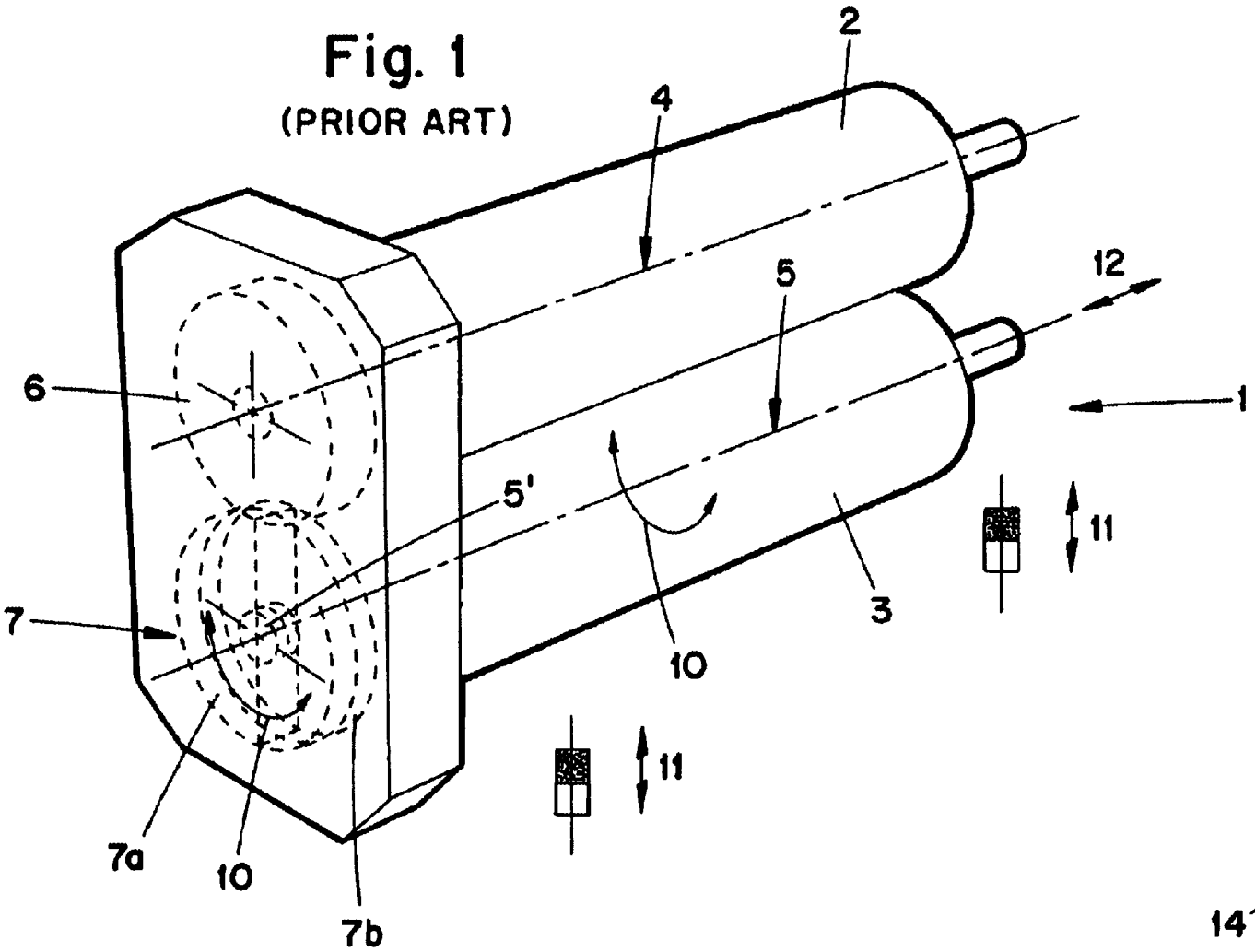
Fig. 1 (PRIOR ART)
FIG. 1 is a perspective view of an adjustable creasing tool of prior art type.
Figure 2:
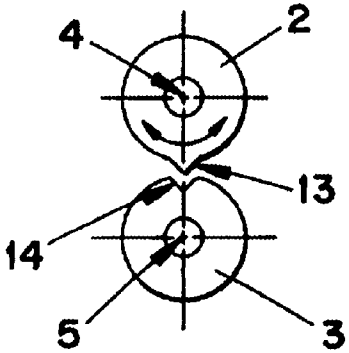
Fig. 2 (PRIOR ART)
FIG. 2 is an end elevation of co-operating male and female rollers in the creasing tool.

FIG. 1 shows a prior art adjustable creasing tool 1 with two creasing rollers included, a male roller 2 and a female roller 3 which are provided, for mutual cooperation, with ridges or crests 13 and grooves or troughs 14, respectively, as shown in FIG. 2. The creasing rollers 2 and 3 are journalled for rotation about shafts 4 and 5 in a machine frame (not shown here). In their one end 4' and 5', respectively, the rollers are rotationally connected to gear wheels 6, 7 which mesh with each other and are journalled in a transmission housing 8. This is secured in the machine frame. One of the shafts 4, 5 is connected to a motor (not shown).

The gear wheel 7 is transversely split in relation to its shaft axis 5 so that the thus formed parts 7*a* and 7*b* are mutually rotary after disengagement of a releasable clamping element (not shown) which normally holds them together.

Figure 3:
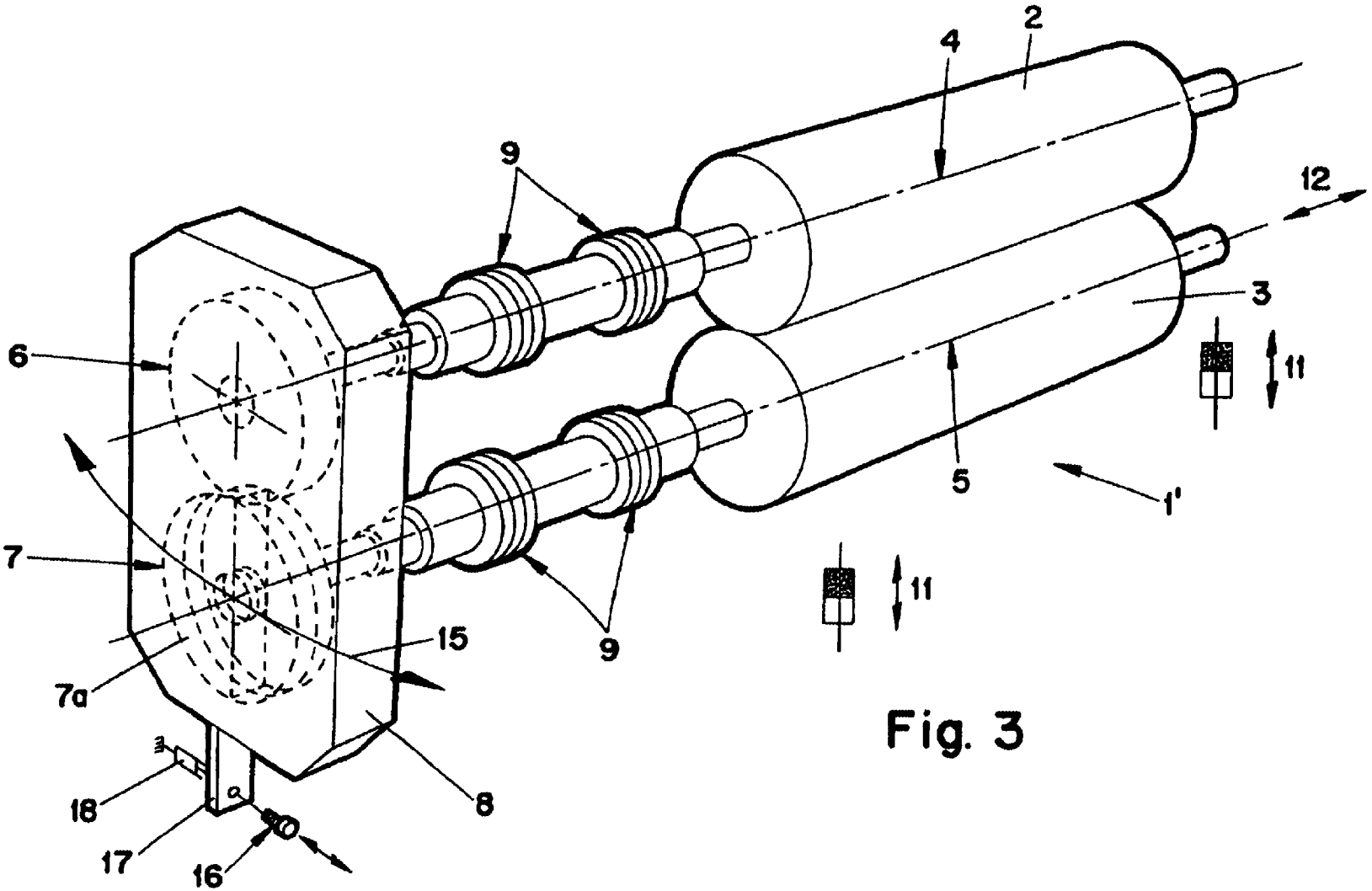
FIG. 3 is a perspective view of one embodiment of an adjustable creasing tool according to the present invention.

In a manner corresponding to that of FIG. 1, FIG. 3 shows an adjustable creasing tool 1' according to the present invention, with creasing rollers 2 and 3 which are rotary about shafts 4, 5. In this instance, the rollers 2, 3 are not, as in the prior art embodiment according to FIG. 1, connected directly to the gear wheels 6 and 7, there being provided, between the rollers 2 and 3 and their respective gear wheels, rotationally fixed, and radially as well as axially limited flexible couplings 9. The couplings 9 consist of flexible steel disk couplings of previously well-known type which permit a certain, limited angular oblique adjustment and axial movement. The couplings are two in number on each shaft 4, 5 in order, in a per se known manner in such couplings, to equilibrate the angular speed during each rotational turn of the shaft. The gear wheels 6 and 7 fixedly disposed on the shafts 4 and 5 are housed and journalled in the transmission housing 8 which is suspended for limited pivoting about the shaft 4 in accordance with the arrow 15. Means are provided for fixing the transmission housing 8 in the desired pivotal position in relation to the machine frame. In this case, such means consists of a fine-threaded adjustment screw 16 disposed in a corresponding thread in the frame. The screw 16 is intended to act against one side of a flange 17 at the lower short side of the transmission housing 8, the position of the flange 17 being fixed in a direction towards the screw by a hydraulic spring 18.

FIG. 4*a* shows in cross section an alternative embodiment of the end portion 31 of the creasing tool 1' located along the geometric axis 4, as well as an alternatively designed device for adjusting the mutual rotational position of the rollers 2, 3 housed there. The portion 31 is provided with a flange 19 on which a gear wheel 20, corresponding to the gear wheel 6 in the embodiment accounted for above, is releasably secured by means of a bolt union 29 (only one shown), which are accommodated in arcuate slots 30 in the gear wheel 21. The gear wheel 20 has an axial extension in the form of an abutment 21. The abutment is radially penetrated by a bolt 23 disposed in a free-play hole 22. The bolt 23 in turn penetrates a threaded pin 25 (shown in partial cross section) which is located in a radially oriented slot 24 which is adapted to the bolt 2') and is disposed in the abutment 21. The pin 25 extends axially from the slot 24 into an additional slot 26 conjured like the slot 24 but having, however, a slightly angled orientation compared with the radial extent of the slot 24 (see FIG. 4*b*). Analogous with the foregoing, a fixed flexible coupling 9, restricted both radially and axially, is provided (not shown in FIG. 4*a*).

FIG. 4*b* shows, as a scaled-down view taken along the section Ivb—Ivb in FIG. 4*a*, the gear wheel 20 as a schematic plan view. In order not to unnecessarily complicate the view, the head of the bolt 23 has been omitted. Moreover, for the same reason only one of the heads of the bolts which together form the above-mentioned releasable bolt union between the gear wheel 20 and the abutment 21 is shown. The view shows how the spacing of the pin 25 to the shaft 4 is positively determined in response to the depth of engagement of the bolt 23 in the pin 25. Thereby, each pin position in the two slots corresponds to a fixed mutual position of rotation for the two rollers 2, 3.

The adjustment of the mutual position of the rollers 2, 3 either axially in accordance with the double-headed arrow at 12, rotationally in accordance with the double-headed arrow 10, or adjustment of the mutual spacing of the rollers in accordance with the arrows 11, entails, in the prior art creasing tool according to FIG. 1, problems which were addressed by way of introduction In the creasing tool according to the present invention, the above-mentioned adjustments may readily be carried out without the need per se of any split gear wheel 7 with releasable clamping union. Nevertheless, such a gear wheel is provided in order, in connection with operational start-up, initially to set a desired flank play between the flanks of the gear wheels 6 and 7, since precision gear wheels with flank play which is so slight that this need is satisfied are not available. However, once this setting has been carried out, it need not be deranged in connection with the above-mentioned adjustments.

In order to carry out the axial adjustment (according to the arrow at 12), on one of the shafts, here the shaft 5, use is made of known clamping and pretensioning devices (not shown).

In order to adjust the mutual spacing (according to the arrows at 11) between the shafts 4, 5, use is made of known splines (not shown) which act between surfaces intended for this purpose in the machine frame and the journals of the shafts 4 and 5 and whose position is altered manually or by machine, for example by means of per se known fine-threaded adjustment screw devices.

In order to adjust the mutual rotational position of the rollers 2, 3, the transmission housing 8 may, with a device in a first embodiment according to FIG. 3, be rotated somewhat in either direction about the shaft axis 4 in relation to the machine frame. In that the adjustment takes place when the creasing tool 1 is not in operation, all of its component parts are stationary. In such instance, by rotating the screw 16 acting on the flange 17 inwards or outwards, the transmission 8 is pivoted, against the action of the hydraulic spring 18, in the desired direction in accordance with the double-headed arrow 15. By the mutual positive action between the gear wheels 6, 7 and the journals of the rollers which are fixed in the direction of rotation, the roller 3 will here be rotated in relation to the stationary roller 2 until the desired adjustment has been achieved.

In order to adjust the mutual position of rotation of the rollers 2, 3, an alternative device according to FIGS. 4*a* and 4*b* may be employed. The gear wheel 20, here corresponding to the gear wheel 6 in the first embodiment, is fixed at the abutment 21 by means of releasable bolt unions (not shown). After their release, the mutual position of rotation between the gear wheel 20 and the abutment 21 will, by rotating the bolt 23, be positively displaceable in the desired direction This displacement, which of course must take place when the creasing machine is not in operation, is possible thanks to the fact that all of the remaining components of the creasing machine 1' are, in principle, fixed. The positive displacement of the pin 25 in its slot 24 and the slot 26 which, in accordance with the foregoing, the pin 25 likewise penetrates, forces the flange 19 and thereby the creasing roller 2 to rotate in the intended direction depending upon the direction of displacement of the pin, as is intimated by means of an arrow 27 in FIG. 4*b*. In principle, it is of no consequence on which of the shaft 4 or 5 the displacement device is placed. In those cases where, in accordance with the above description, a transversely split gear wheel is employed, it is, however, preferred—in order that the construction is not unduly complicated—that the adjustment device according to FIGS. 4*a* and 4*b* be disposed at the gear wheel which is not transversely split. Moreover, a radial scale 28 disposed on the wheel 20 is apparent from FIG. 4*b*. The scale is designed so that it gives the observer a direct read-off of the mutual position of rotation of the rollers 2 and 3.

Considering that all of the adjustments desired in such an adjustable creasing tool are small, at most some tenths of a millimetre, it is possible, thanks to the couplings 9 permitting limited movement and the pivotal transmission housing 8, to carry them out without the need to disengage the releasable union for the split gear wheel 7.

What is claimed is:

1. An apparatus in an adjustable creasing tool, which comprises:

two mutually operating creasing rollers, a male roller and a female roller;

a gear wheel transmission with a housing for operation and mutual coordination of the creasing rollers;

means for adjusting the mutual position of rotation of the two creasing rollers;

means for adjusting the position of one of the creasing rollers along its axis of rotation;

means for adjusting the mutual spacing between the shafts of the creasing rollers;

wherein for adjustment of the position of one of the creasing rollers along its axis of rotation and for adjusting the mutual spacing between the axes of rotation of the creasing rollers, at least one shaft is fixedly connected to a gear wheel in the gear wheel transmission by means of two rotationally rigid, both radially and axially limited, flexible couplings in order to permit adjustment of the mutual position of the rollers without the need to affect the meshing relationship of the transmission.

2. The apparatus as claimed in claim 1, wherein for adjusting the mutual position of rotation of the rollers, the transmission housing is restrictedly rotatably fixed in the frame of the creasing tool about one of the shafts of the transmission.

3. The apparatus as claimed in claim 1, wherein for adjusting the mutual position of rotation of the rollers, one of the unions of the gear wheels fixed in relation to its roller is releasable, the roller being rotary in relation to the releasable gear wheel.

4. The apparatus as claimed in claim 3, wherein said mutual position of rotation adjusting means includes a pin radially displaceable in the gear wheel by means of an adjustment screw, which is displaceably accommodated in a slot in the shaft which is obliquely inclined in relation to the radial direction.

5. The apparatus as claimed in claim 1, wherein said flexible couplings comprise two flexible steel disk couplings disposed on each shaft and which each permits both limited flexing and limited axial movement.

* * * * *